United States Patent [19]

Grieshaber

[11] 3,998,452

[45] Dec. 21, 1976

[54] DEVICE FOR REGULATING A FEEDING STROKE

[75] Inventor: Charles Grieshaber, Ecublens, Switzerland

[73] Assignee: J. Bobst & Fils, S.A., Prilly, Switzerland

[22] Filed: May 15, 1975

[21] Appl. No.: 577,940

[30] Foreign Application Priority Data

May 22, 1974 Switzerland ..... 7092/74

[52] U.S. Cl. ..... 271/267; 271/99; 271/139

[51] Int. Cl.[2] ..... B65H 3/08; B65H 5/10

[58] Field of Search ..... 271/139, 132, 99, 102, 271/144, 267, 268, 269; 74/42, 47

[56] References Cited

UNITED STATES PATENTS

| | | | |
|---|---|---|---|
| 748,125 | 12/1903 | Weber | 271/269 |
| 1,002,529 | 9/1911 | Lee | 271/267 |
| 1,170,214 | 2/1916 | Axelstrom | 271/144 X |
| 1,229,513 | 6/1917 | Peters et al. | 271/267 X |
| 1,884,949 | 10/1932 | Woodcock et al. | 271/99 |
| 3,202,420 | 8/1965 | Dovey | 271/99 |

*Primary Examiner*—John J. Love
*Assistant Examiner*—Bruce H. Stoner, Jr.
*Attorney, Agent, or Firm*—Hill, Gross, Simpson, Van Santen, Steadman, Chiara & Simpson

[57] ABSTRACT

An adjustable connection between a reciprocating rod and a rocker arm which is connected through a rotatable shaft to a linkage which shifts at least one feeding unit in a reciprocating feed stroke in response to movement of the rocker arm characterized by the rocker arm having a slot receiving a block which is pivotably attached to the end of the rod and which block is adjustably positioned in the slot to vary the effective length of the rocker arm and thus varies the length of the feeding stroke for the feeding unit. Preferably, the slot in the rocker arm lies on a line extending perpendicular to a longitudinal axis of the rod when the rocker arm is in one position so that one end of the feeding stroke of the feeding unit remains in a constant and fixed position relative to the device regardless of changes in the length of the stroke.

4 Claims, 3 Drawing Figures

DEVICE FOR REGULATING A FEEDING STROKE

BACKGROUND OF THE INVENTION

Field of the Invention

The present invention is directed to an improvement in a driving device for a feeding unit of a device such as a die cutting press which improvement enables an adjustment in the length of the stroke of the feeding unit while maintaining one end of the feeding stroke fixed relative to the device or press.

Prior Art

In devices such as die cutting presses for cutting carton blanks from paste board or heavy paper, a feeding device transfers a sheet of paste board or heavy paper from a stack into a position at which the sheet is gripped by a gripper bar carried by a pair of endless chains which are supported and driven by sprocket wheels. The gripper bars and pair of chains form a continuous belt conveyor which intermittently conveys the sheet through the machine with dwells at one or more stations to enable various operations such as die cutting the carton blanks into the sheet, stripping waste from the die cut sheet, and delivery of the cut and stripped sheet from the machine. The feeding device, such as one or more suction feeding heads is reciprocated during a dwell period of the endless chain through a feeding cycle to insert or deliver a leading edge of the sheet to an awaiting and opened gripper bar of the conveying chain. To operate the feeding device, a drive means, which includes a rocker arm connected to a reciprocating rod, reciprocates the feeding device between two positions during each feeding cycle. The rod is reciprocated by one or more cams which are rotated in relationship with the rotation of the main drive for the device or press so that the feeding cycle is synchronized with the movement of the gripper bars on the chain and with the operation of the various work stations such as the stripping station and the die cutting platen.

To obtain the desired registry of each blank being processed, the spacing between the gripper bars on the chain conveyor is critical and the opened gripper bar which receives the sheet from the feeding device is positioned in an exact position on the press. Thus, the amount of the leading edge of a sheet received in the opened gripper bar will determine the registry of the pattern printed on the sheet and a pattern of cutting knives at the die cutting and creasing station.

Since the endless chains are made up of a plurality of interconnected links, wear of each link will increase the length of the chain and the spacing between the gripper bars. While the total lengthening of the chain can be compensated by chain tighteners, variations due to wear of the chain in the spacing between the gripper bars must be compensated by controlling the amount of the sheet's leading edge which edge is inserted into the opened gripper bar by the feeding device.

SUMMARY OF THE INVENTION

The present invention is directed to a feeding device in which the feeding stroke of the feeding unit is adjustable particularly to enable changing the amount of a leading edge of a sheet which edge is inserted into an opened gripper bar by the feeding unit.

To accomplish these tasks, the feeding device has a feeding unit having a feeding stroke between a first and second position to feed a sheet of material into the sheet processing device, said feeding device including means for reciprocating the feeding unit between said positions during a feeding cycle, said means including a rocker arm mounted on a shaft and connected to a rod, means for reciprocating the rod to move the rocker arm in an arc between a pair of positions to oscillate the shaft, and linkage means for transferring the movement of the shaft to reciprocate the feeding unit through the feeding stroke with the improvement comprising a pivotable connection between the rod and rocker arm, and means for positioning the pivotable connection at varying radial distances from the center of the shaft so that the effective length of the rocker arm is changed to vary the length of the feeding stroke of the feeding unit.

Preferably, the pivotable connection comprises a slot or groove provided in the rocker arm, a block pivotably connected to one end of the rod and slidably received in the slot. The means for positioning the pivotable connection preferably comprises a screw holding the block against one side of the groove or slot. Preferably, the slot extends perpendicular to a longitudinal axis of the rod as the rocker arm is in one of the pair of positions so that one position of the feeding unit during the feeding stroke remains fixed as the length of the feeding stroke is changed. To accomplish this, the slot in the rocker arm extends along a line at an acute angle to the radial length of the rocker arm so that the slot extend perpendicular to the axis of the rod when the rocker arm is in the one position. It is desirable to provide indicia along an edge of the slot or groove to indicate the position of the block in the slot or groove.

DESCRIPTION OF THE PREFERRED EMBODIMENTS

Figure 1:
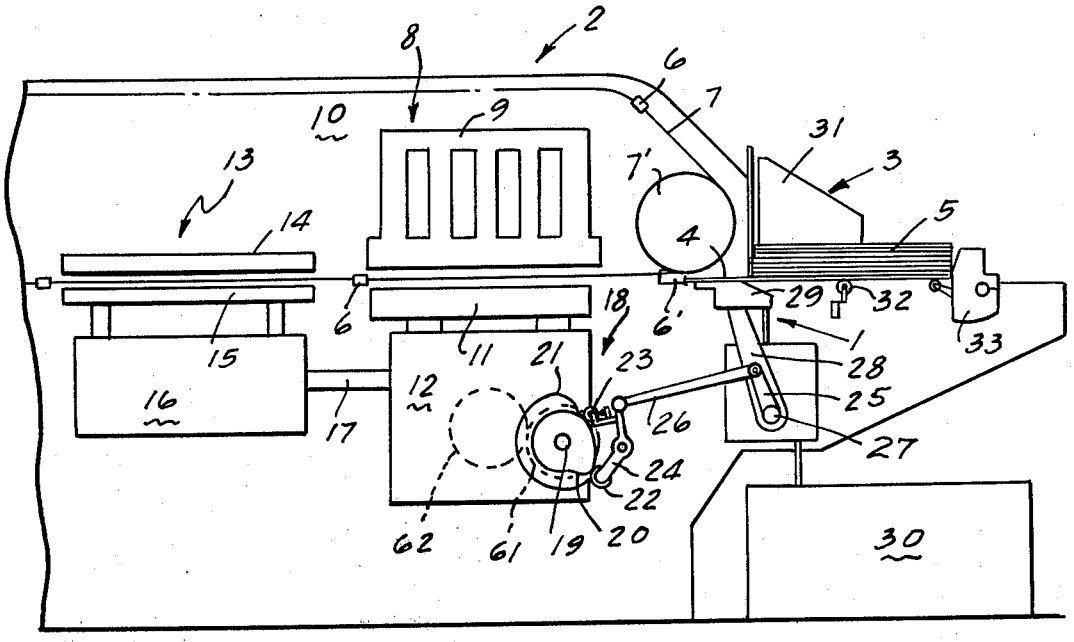
FIG. 1 is a schematic illustration of a device utilizing the improvement of the present invention.

The principles of the present invention are particularly useful when incorporated in drive means 18 for reciprocating a feeding unit or device 1 of a feeding station or table 3 for a device such as platen press 2 of FIG. 1. The feeding station 3 introduces a sheet 4 from a pile 5 to the press 2. As illustrated, the press 2 has a conveyor 7 comprising a pair of chains carrying spaced gripper bars 6 which grasp a leading edge of a sheet 4 of material and convey it through the press 2 to be worked on by one or more working stations. The partial illustration of the press 2 includes a die cutting and creasing station 8 comprising a fixed platen or beam 9, mounted in a frame 10 of the press, a movable platen 11 which is positioned beneath the fixed plate 9 and is reciprocated toward the fixed platen 9 by means which is diagrammatically illustrated as a box 12 and which is driven by a suitable power source such as an electric motor. As the movable platen 11 is reciprocated against the fixed platen 9, knives and creasing members which are carried on one of the two platens will cut and crease a sheet which is disposed between the platens, with the desired pattern for one or more blanks to form a die cut sheet. An illustrative example of a die cutting and creasing station, which may be used in the press 2, is disclosed in U.S. Pat. No. 2,507,556, which issued to Henri Bobst on May 16, 1950.

The press 2 has a second or stripping station 13 having a fixed upper member 14 and a movable lower member or craddle 15. The movable member 15 is reciprocated towards the fixed member 14 by means, which is illustrated as a box 16, to strip or remove waste material from the die cut sheet. The means 16 is actuated by a drive shaft 17 which extends to the means 12 and is driven thereby. An illustrative example of a stripping station is disclosed in U.S. Pat. No. 3,060,776, which issued to H. Bobst et al. on Oct. 30, 1962.

After the sheet has been processed at the stripping station, the sheet is conveyed to a delivery station (not illustrated). At the delivery station, the sheet is released from the gripping bar and is either collected in a stack or transferred to a device for further processing.

The conveyor 7 with the gripper bars 6 have a plurality of sprocket wheels such as 7' and is driven through a suitable cam arrangement or mechanical linkage (not illustrated) by the means 12 for reciprocating the platen 11 so that the gripper bars 6 move intermittently through each station with a dwell period during an actuation or movement of the platen 11 and member 15.

The feeding table or station 3 may be a separate unit or preferably is provided on the input end of the frame 10 of the device 2. The station 3, as illustrated, includes a hopper or storage device 31 for receiving the stack 5 of the sheets 4 of material which may be paste board or heavy paper and are to be subsequently die cut to form a plurality of blanks for cartons. Beneath the hopper 31, the frame 10 is provided with means for supporting the stack which is illustrated as rollers 32 and an adjustable support 33 which is movable along the main frame 10 to enable handling a stack having different lengths.

To feed a sheet 4 from the stack 5 so that its leading edge is received in an open gripper bar 6' (FIG. 2), feeding table 2 has the reciprocating feeding unit or device 1 which has a feeding head 29 which may be a suction feeding head or plate. The head 29 is attached via a flexible conduit to a vacuum or suction source 30.

The drive means 18 includes a shaft 19 having a pair of cams 20 and 21 forming a double cam system. The shaft 19 is rotated by the means 12 either by a drive train or by gear 61 attached to the shaft 19 and engaging a gear 62 on an output shaft of the means 12. A pair of rollers or followers 22 and 23 are attached at opposite ends of a pivotably mounted lever 24 with the roller 22 disposed on one end and engaging the cam 20 and the roller 23 being mounted on a pivoting lever attached to the other end of the lever 24 and biased into engagement with the cam 21 by a plurality of spring washers disposed between the pivoting lever and the end of the lever 24. The biasing of the roller 23 ensures that both rollers or followers 22 and 23 are in continual contact under pressure with their respective cams. One end of the pivotably mounted lever 24, such as the end adjacent the roller or follower 23, is connected to a rocker arm or lever 25 through a pull rod 26. As illustrated, the rod 26 is pivotably connected to the one end of the lever 24 and pivotably connected to the rocker arm 25 which is supported on a shaft 27 whose movement is linked by linkage means comprising a control arm or lever 28 to the suction plate or feeding head 29.

Figure 2:
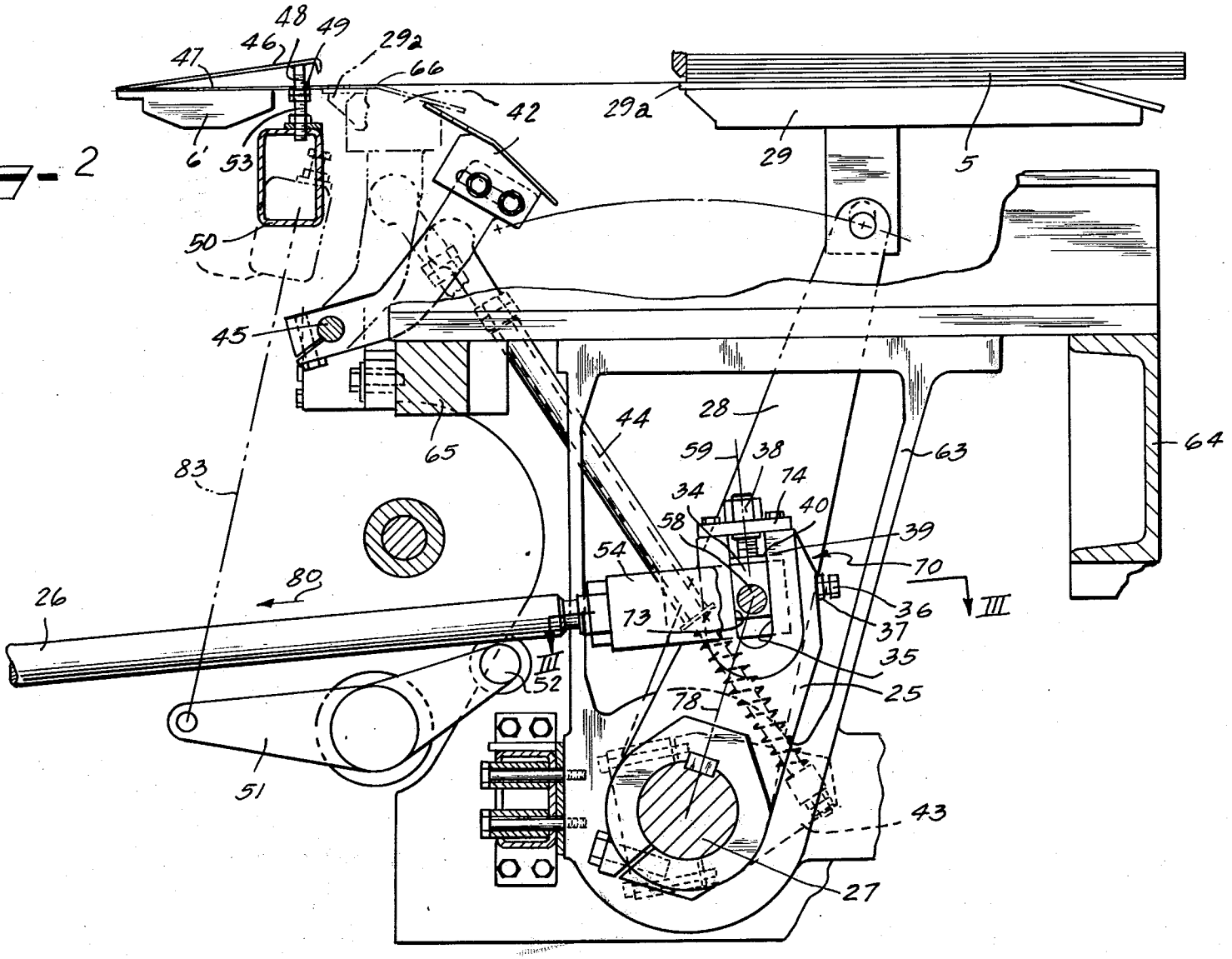
FIG. 2 is an enlarged view of the improvement of the present invention with portions broken away for purposes of illustration.

As best illustrated in FIG. 2, the shaft 27 is supported for rotation or oscillating movement about its axis by a frame support 63 which is connected to the frame 10 by cross members 64 and 65. The arm 28 is connected to the feeding head 29 by a lost motion connection and shifts the head 29 along a horizontal plane from the position illustrated in FIG. 2 at the beginning of the feed stroke of the feed cycle to a second position such as illustrated in FIG. 1 and shown in broken lines in FIG. 2. In addition thereto, a movable tablet or member 42 has an arm which is pivotably mounted on a rod 45 and moves in the arc from the position illustrated into a position illustrated in broken lines with the upper surface extending along a flat surface such as 66 and adjacent the leading edge **29*a* of head 29. To rotate the movable tablet 42, the shaft 27 is provided with a linkage having an arm 43 connected to an adjustable pull rod 44 which moves member 42 in an arcuate path on the rod or shaft 45**.

Figure 3:
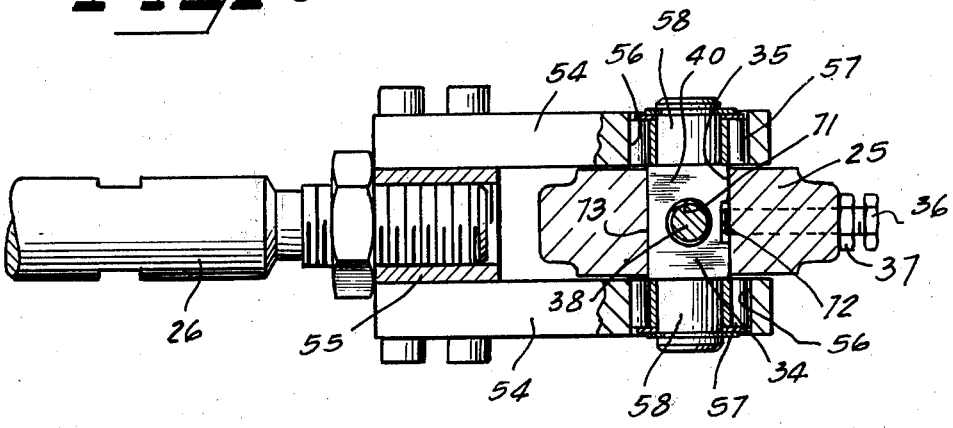
FIG. 3 is a cross section taken along lines III—III of FIG. 2.

The improvement in the means for reciprocating the feed head 29 during the feeding cycle is means generally indicated at 70 for changing or varying the effective length of the rocker arm 25 so that for a given distance of the movement of the rod 26, the arm 28 is moved through a different arcuate distance. The means 70 comprises a pivotable connection formed by a slot or groove 35 provided in the rocker arm 25 which slot slidably receives a block 34 (FIG. 3) which is pivotably attached to the rod 26. The block 34 (FIG. 3) is provided with a pair of cylindrical portions 58, 58 which are axially aligned and extend from opposite sides. The end of the rod 26 is threadably received in a housing or block 55 which has a pair of plates 54, 54 attached to each side. Each of the plates 54 is provided with an aperture 56 containing a roller or ball bearing unit 57 which engages the projection 58 to form the pivotable connection between the rod and block. The block 34 is provided with a threaded aperture 71 and adjacent thereto a groove 72 along one side thereof.

To hold the block 34 in the desired axial position of the slot 35, the rocker arm 25 has a threaded member 36 which is provided with a counter nut 37 and extends into the slot 35 from one side. An end of member 36 is received in the groove 72 to clamp a side 73 of the block against an opposite side of the slot 35. In addition thereto, an open end of the slot is covered by a plate 74 which carries a threaded adjustment member or set screw 38 that is threadably received in the threaded aperture 71. To indicate the position of the block 34, the slot is provided with a group of marks or indicia 39 which when aligned with an upper end 40 of the block 34 indicate the position of the block in the slot.

The adjustment of the block 34 in the slot 35 is accomplished by loosening the threaded member 36, then turning the threaded member 38 to raise or lower the block as desired. After obtaining the desired position of the block, the threaded member 36 is again tightened to clamp the block against the opposite edge of the slot 35.

As illustrated in FIG. 2, the slot 35 is positioned on the rocker arm 25 so that the slot extends substantially perpendicular to the longitudinal axis of the rod 26 when the rocker arm assumes one position such as the position illustrated in FIG. 2. Thus, the axis of the slot indicated by a line 59 forms an acute angle with an axis 78 of the rocker arm. The provision of the axis 59 of the slot 35 being perpendicular to the axis of the rod 26 maintains the one position of the rocker arm 25 constant regardless of the movement of the block 34 in the slot 35. Therefore, regardless of the increase or decrease in the stroke of the feeding unit or device 29, one position or end of the stroke which is the position illustrated in FIG. 2, remains constant relative to the frame of the press 2. Changes in the effective length of the feeding stroke are thus limited to changing the end position of the stroke adjacent to the opened gripper bar 6' as the rod 26 moves in the direction of arrow 80. An adjustment of the position of the block 34 in the slot 35 will change the distance of movement of both of the feeding head 29 and tablet 42 with the change occurring at the end of the stroke adjacent the opened gripper bar 6'.

To theoretically obtain no change in the position of suction head 29 from its position beneath the stack 5 (FIG. 2), the slot 35 should be milled as a curved slot of a segment of a circle having a radius equal to the length of rod 26. However, since the length of rod 26 would provide a large radius and since a slot on a tangential line of the circle with this radius would not produce any practical shifting of the head 29 while in the position under the stack, the use of a slot 35 which extends perpendicular to the axis of rod 26 will reduce manufacturing expenses and be satisfactory.

Each of the gripper bars (see 6' of FIG. 2) has a plurality of spaced grippers which have spring fingers which are formed by an upper flat spring 46 connected at one end to a lower spring 47. The upper flat spring 46 includes a lug 48 which extends through an aperture 49 in the lower spring 47. To open the fingers of the gripper bar, a device having a member or rectangular tube 50 which extends the length of the gripper bar is provided. The tube or member 50 is connected to a lever arm (not illustrated) so that it will move in an arc between the position illustrated and the position shown in broken lines. To shift the member 50 along the arc, a lever 51 has a cam follower 52 on one end which follower 52 engages a cam surface (not illustrated). The other end of the lever 51 is connected by a linkage 83 (illustrated by broken lines) to transmit the rocking movement of the lever 51 to the tube 50. As illustrated, the tube 50 is provided with adjustable screws 53 for engaging the lug 48.

Operation of the feeding unit can best be described by referring to FIGS. 1 and 2. During a dwell period of the conveyor means 7, the gripper bar 6' is opened by the device 50 to receive the sheet such as 4. The feeding head 29 is in the position beneath the stack 5 (FIG. 2). Reciprocation of the rod 26 in the direction 80 causes the arm 28 and the feeding head 29 to move to the position illustrated in FIG. 1 to transport a bottom sheet of the stack to a position with its leading edge or end being inserted into the open springs of the gripper bar 6'. Due to the arrangement of the cams, the gripper bars can be closed prior to reciprocation of the feeding head in the opposite direction to the position illustrated in FIG. 2. By adjusting the position of all of the cams involved, synchronization of the movement of the feeding unit 1 with the operation of the other stations of the device 2 can be obtained.

By adjusting the effective length of the rocker arm 25, a change in the length of the stroke for the feeding head 29 of the device 1 can be accomplished with one portion of the stroke remaining fixed relative to the device 2. While the length of the rod 26 can be adjusted such as by the threaded connection of the rod to the housing or block 55 (FIG. 3), the stroke of the rod 26 is determined by the change in the cam surfaces such as 20 and 21. Thus, changing the effective length of the rocker arm enables an easy and quick adjustment in the stroke of the feeding device to adjust the amount of insertion of the sheet's leading edge into the fingers of the gripper bars.

Although various minor modifications may be suggested by those versed in the art, it should be understood that I wish to employ within the scope of the patent granted hereon all such modifications as reasonably and properly come within the scope of my contribution to the art.

I claim:

1. In a feeding device having a feeding unit having a feeding stroke between a first and second position to feed a sheet of material into a sheet processing device, said feeding device including means for reciprocating the feeding unit between said positions during a feeding stroke, said means including a shaft mounted for oscillation, a lever mounted on said shaft and connected to the feeding unit, a rocker arm mounted on said shaft, a rod having one end attached by an adjustable pivotable connection to said rocker arm and means for reciprocating the rod to move the rocker arm in an arc between a pair of positions to oscillate the shaft and move said lever in an arc to reciprocate the feeding means through the feeding stroke, the improvement comprising said adjustable pivotable connection comprising a slot being provided in said rocker arm and extending perpendicular to a longitudinal axis of said rod as the rocker arm assumes one of said pair of positions, a block pivotably connected to said one end of the rod and slidably received in said slot, and means for adjusting the position of the block in the slot to vary the effective length of the rocker arm to change the length of the feeding stroke of the feeding unit with one of said first and second positions of the feeding unit remaining fixed as the length of the feeding stroke is changed.

2. In a feeding device according to claim 1, wherein the slot extends along a line at an acute angle to the radial length of the rocker arm.

3. In a feeding device according to claim 1, wherein the means for adjusting the position of the block comprises a threaded member for shifting the block along the length of the slot and a screw holding the block against one side of the slot.

4. In a feeding device according to claim 1, wherein indicia are provided along an edge of the slot to indicate the position of the block in the slot.

* * * * *